US010598438B2

(12) United States Patent
Balaschak et al.

(10) Patent No.: US 10,598,438 B2
(45) Date of Patent: Mar. 24, 2020

(54) SUPPORT FIXTURE

(71) Applicant: General Electric Company, Schenectady, NY (US)

(72) Inventors: Edward James Balaschak, Simpsonville, SC (US); Robert Peter Hanet, Canton, MI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 32 days.

(21) Appl. No.: 15/221,235

(22) Filed: Jul. 27, 2016

(65) Prior Publication Data

US 2018/0031322 A1 Feb. 1, 2018

(51) Int. Cl.
*F27D 5/00* (2006.01)

(52) U.S. Cl.
CPC ..... *F27D 5/00* (2013.01)

(58) Field of Classification Search
CPC ..... F27D 5/00; F27D 5/0006; F27D 5/0012; F27D 5/0018; F27D 5/0025
See application file for complete search history.

(56) References Cited

U.S. PATENT DOCUMENTS 2,246,448 A 6/1941 Mahan, Jr.
2,314,534 A * 3/1943 Wind ..... F27D 5/0018 432/258
3,160,931 A 12/1964 Leach
3,585,258 A 6/1971 Levinson
3,732,048 A 5/1973 Guerga et al.
4,126,651 A 11/1978 Valentine
4,212,690 A * 7/1980 Frosch ..... C21D 9/0025 148/559
4,219,328 A 8/1980 Pasco et al.
4,278,622 A 7/1981 Suh
4,300,318 A 11/1981 Brown
(Continued)

FOREIGN PATENT DOCUMENTS

DE 102012002955 8/2012
DE 102017126189 A1 5/2018
(Continued)

OTHER PUBLICATIONS

U.S. Appl. No. 15/205,049, Office Action 1 dated Aug. 29, 2017, 26 pages.
(Continued)

*Primary Examiner* — Steven S Anderson, II
(74) *Attorney, Agent, or Firm* — Hoffman Warnick LLC

(57) ABSTRACT

In one embodiment, a fixture for supporting a body in an oven includes a plurality of support ribs to support the body, and a support element to support and connect the plurality of support ribs. Each support rib has a length, a width, a thickness, and a first end. The length extends from the support element to the first end, and the width extends perpendicular to the length. The length varies across the width of at least one support rib. In another embodiment, a fixture for supporting a body in an oven includes a plurality of connected support ribs to support the body. Each support rib is spaced from at least one other support rib. The length differs for at least a first support rib of the plurality of support ribs with respect to at least a second support rib of the plurality of support ribs.

18 Claims, 7 Drawing Sheets

(56) References Cited

U.S. PATENT DOCUMENTS

| | | | | |
|---|---|---|---|---|
| 4,561,902 | A | 12/1985 | Lee | |
| 4,706,730 | A | 11/1987 | Sanchez-Caldera et al. | |
| 4,729,804 | A * | 3/1988 | Dillner | B23Q 1/032 156/289 |
| 4,890,662 | A | 1/1990 | Sanchez-Caldera et al. | |
| 5,330,343 | A | 7/1994 | Berteau | |
| 5,340,417 | A | 8/1994 | Weiner et al. | |
| 5,702,501 | A | 12/1997 | Osawa et al. | |
| 5,874,377 | A | 2/1999 | Apte | |
| 6,197,243 | B1 | 3/2001 | Tiegs et al. | |
| 6,344,635 | B2 | 2/2002 | Brennan | |
| 6,390,179 | B1 | 5/2002 | Yasrebi et al. | |
| 6,403,020 | B1 | 6/2002 | Altoonian et al. | |
| 6,808,010 | B2 | 10/2004 | Dixon et al. | |
| 7,112,769 | B2 | 9/2006 | Del Regno | |
| 7,287,573 | B2 | 10/2007 | McNulty et al. | |
| 7,435,368 | B2 | 10/2008 | Davidson et al. | |
| 7,780,905 | B2 | 8/2010 | Dodds | |
| 8,794,297 | B1 | 8/2014 | McNulty et al. | |
| 9,096,472 | B2 | 8/2015 | Foster et al. | |
| 2001/0020762 | A1 * | 9/2001 | Helm | B23Q 1/032 269/21 |
| 2002/0018877 | A1 * | 2/2002 | Woodall | B23Q 1/032 428/180 |
| 2003/0071037 | A1 | 4/2003 | Sato et al. | |
| 2003/0185698 | A1 | 10/2003 | Wang et al. | |
| 2004/0159985 | A1 | 8/2004 | Altoonian et al. | |
| 2005/0070651 | A1 | 3/2005 | McNulty et al. | |
| 2005/0249627 | A1 | 11/2005 | Want et al. | |
| 2008/0241404 | A1 | 10/2008 | Allaman et al. | |
| 2012/0227761 | A1 | 9/2012 | Leighton et al. | |
| 2013/0048471 | A1 * | 2/2013 | Capps, Jr. | B65G 15/58 198/692 |
| 2014/0251381 | A1 | 9/2014 | Markowski, III | |
| 2014/0274658 | A1 | 9/2014 | Sherwood et al. | |
| 2014/0277385 | A1 | 9/2014 | Bankert et al. | |
| 2015/0209839 | A1 | 7/2015 | Brown et al. | |
| 2015/0241127 | A1 * | 8/2015 | Sonntag | F27D 5/0006 432/258 |
| 2015/0266211 | A1 | 9/2015 | Wolfgang et al. | |
| 2016/0059270 | A1 | 3/2016 | Chen et al. | |
| 2016/0067888 | A1 | 3/2016 | Shome et al. | |
| 2016/0228929 | A1 | 8/2016 | Williamson et al. | |
| 2016/0288420 | A1 | 10/2016 | Anderson, Jr. et al. | |
| 2017/0036401 | A1 | 2/2017 | Donovan et al. | |
| 2017/0082365 | A1 * | 3/2017 | Crafton | F27D 5/00 |
| 2018/0126590 | A1 | 5/2018 | Balaschak et al. | |

FOREIGN PATENT DOCUMENTS

| | | | |
|---|---|---|---|
| EP | 1306148 | B1 | 9/2006 |
| EP | 2024168 | | 8/2012 |
| JP | H11050107 | A | 2/1999 |
| JP | 2015217352 | A | 12/2015 |
| WO | 20080772224 | | 7/2008 |
| WO | 2015177195 | A1 | 11/2015 |

OTHER PUBLICATIONS

U.S. Appl. No. 15/205,049, Final Office Action 1 dated Jan. 3, 2018, 18 pages.
U.S. Appl. No. 15/221,206, Final Office Action dated Jul. 30, 2018, 22 pages.
U.S. Appl. No. 15/205,049, Notice of Allowance dated Oct. 12, 2018, 15 pages.
U.S. Appl. No. 15/205,049,(Office Action) dated Jun. 20, 2018, 27 pages.
U.S. Appl. No. 15/346,856, Office Action dated Mar. 22, 2019, 9 pages.
U.S. Appl. No. 15/346,856, Final Office Action dated Sep. 9, 2019, 10 pages.
U.S. Appl. No. 15/346,840 Office Action dated Jan. 10, 2020, 6 pages.

* cited by examiner

SUPPORT FIXTURE

FIELD OF THE INVENTION

The subject matter disclosed herein relates to a support fixture. Specifically, the subject matter disclosed herein relates to a support fixture for firing parts.

BACKGROUND OF THE INVENTION

Many manufactured parts, such as ceramic parts, require one or more forms of heating or firing, which are carried out in an oven using radiant heat and some form of convection, be it incidentally occurring due to temperature differences in the oven, or artificially and intentionally generated. The parts are laid on a bed of sand in the oven, which serves to support the parts and to radiate heat toward the parts. The bed of sand also detrimentally insulates a large portion of the parts against contact with convecting gas within the oven. As a result, the surfaces of the parts are not heated or fired uniformly. Temperature differentials within the parts can cause cracking or other defects. Further, during some processes, gases within the parts are released, and the sand contacting a large surface area of the parts inhibits this gas release. The trapped gases can cause unwanted voids, or build pressure within the parts that causes cracks or other defects.

BRIEF DESCRIPTION OF THE INVENTION

A first aspect of the disclosure includes a fixture for supporting a body in an oven. The fixture includes a plurality of support ribs to support the body, and a support element supporting and connecting the plurality of support ribs. Each support rib has a length, a width, a thickness, and a first end. The length extends from the support element to the first end, and the width extends perpendicular to the length. The thickness extends perpendicular to the length and the width, the width is longer than the thickness, and the length varies across the width of at least one support rib of the plurality of support ribs.

A second aspect of the disclosure includes a fixture for supporting a body in an oven. The fixture includes a plurality of connected support ribs to support the body. Each support rib on the plurality of support ribs is spaced from at least one other support rib of the plurality of support ribs. Each support rib of the plurality of support ribs has a first face and a second face, at least one of the first face and the second face of each support rib of the plurality of support ribs opposing at least one of the first face and the second face of an adjacent support rib. Each support rib has a length, a width, a thickness, and a first end, the length extending from the support element to the first end, the width extending perpendicular to the length, the thickness extending perpendicular to the length and the width, the width longer than the thickness, the length differing for at least a first support rib of the plurality of support ribs with respect to at least a second support rib of the plurality of support ribs.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

Figure 1:
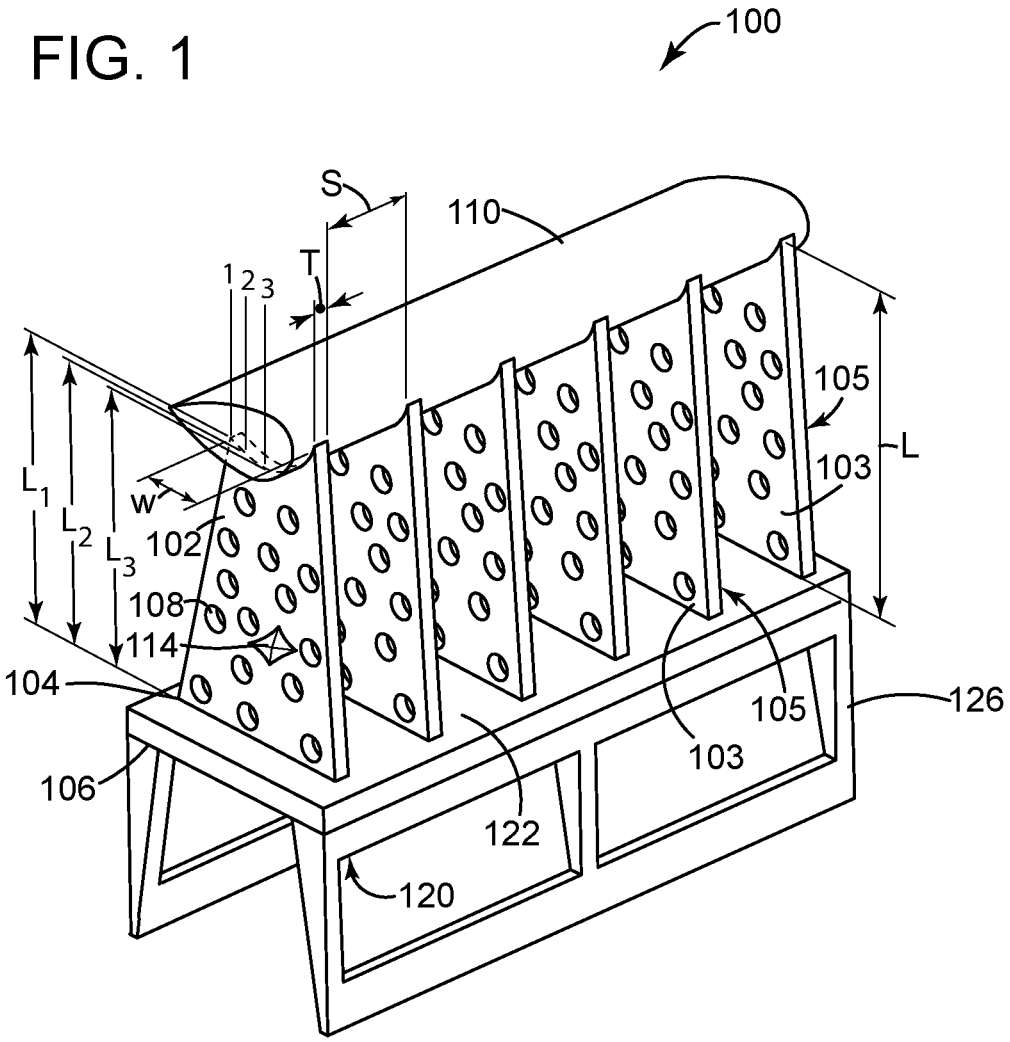
FIG. 1 is a perspective view illustrating a fixture for supporting a body in an oven during a heating or firing process, according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

FIG. 1 is a perspective view illustrating a fixture 100 for supporting a body 110 in an oven during a heating or firing process, such as, but not limited to, debinding and sintering. Fixture 100 can be made from materials that retain their structure and strength at high temperatures. These materials include, but are not limited to, ceramic refractory materials and some metals. Ferrous material, non-ferrous material, and some composite materials can be used. The materials can have a melting point. In some instances, the melting point can be above 500 degrees Fahrenheit (F.), 750 degrees F., 1,000 degrees F., 1,250 degrees F., 1,500 degrees F., 1750 degrees F., 2,000 degrees F., 2,250 degrees F., 2,500 degrees F., 2750 degrees F., 3,000 degrees F., 3,250 degrees F., 3,500 degrees F., 3,750 degrees F., or 4,000 degrees F.

Fixture 100 has a plurality of support ribs 102 to support body 110. Body 110 can be any part, component, or die, of any suitable shape or material, which undergoes a heating or firing process. Support ribs 102 can be spaced from each other and connected at a connection region 104 by a support element 106. Support element 106 can support and stabilize support ribs 102 by directly connecting to each support rib 102, thereby interconnecting support ribs 102.

Support ribs 102 can each have a first face 103 and a second face 105 facing away from first face 103, with one of first face 103 and second face 105 adjacent and opposing one of first face 103 and second face 105 of an adjacent support rib 102. A spacing distance S separates first face 103 of a first support rib 102 from an opposing second face 105 of an adjacent support rib 102. Support ribs 102 can each have a length L, a width W at an end configured for contact with body 110, and a thickness T. Length L extends vertically when fixture 100 is oriented to support body 110. Width W extends perpendicular to L length at the end configured for contact with body 110 (e.g., the top when fixture 100 is oriented to support body 110), and thickness T extends perpendicular to length L and width W. Width W is greater than thickness T. Support element 106 has a dimension parallel to length L of support ribs 102, and length L of at least one support rib 102 is greater than this dimension of support element 106. In some embodiments, length L of all support ribs 102 is greater than the dimension of support element 106. Providing longer support ribs 102 can provide greater space for fluid flow to and around body 110.

Figure 2:
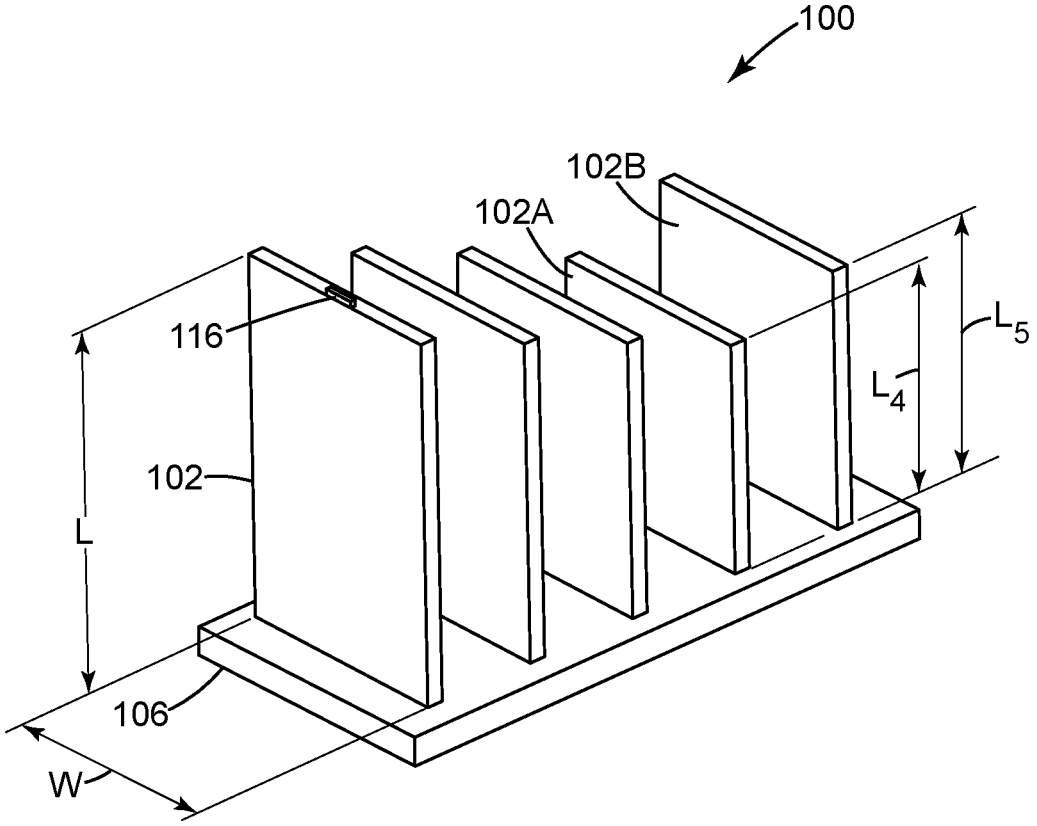
FIG. 2 is a perspective view illustrating the fixture of FIG. 1 with an alternative embodiment of support ribs.
Figure 3:
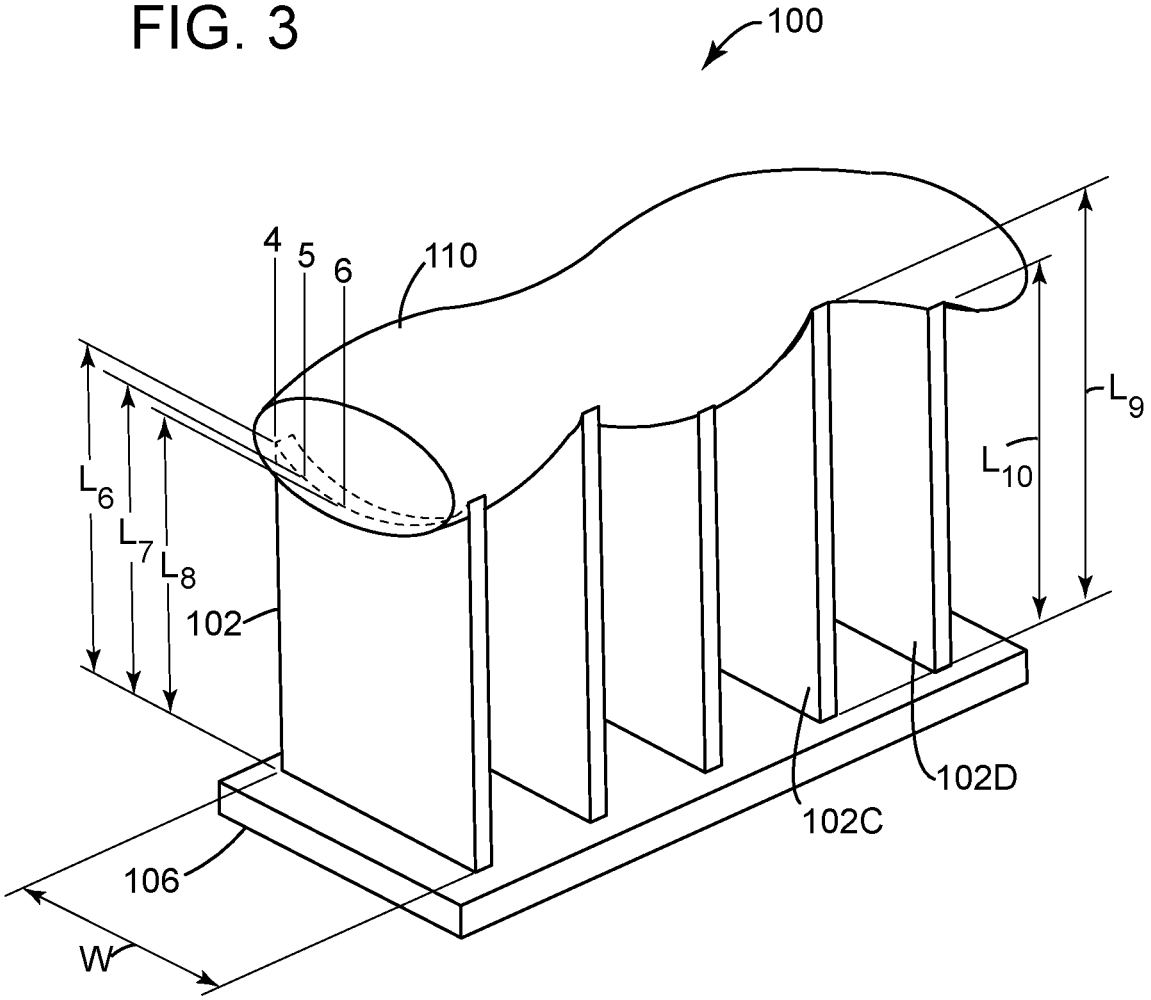
FIG. 3 is a perspective view illustrating the fixture of FIG. 1 with an alternative embodiment of support ribs.

Length L can vary across width W of at least one support rib 102. FIG. 1, for example, shows positions 1, 2, 3 along width W, with respective lengths L1, L2, L3, which vary from each other. Alternatively, as illustrated in FIG. 2, length L can differ for at least a first support rib 102 with respect to at least a second support rib 102. For example, support rib 102A has length L4 and support rib 102B has length L5. In some cases, as illustrated in FIG. 3, length L varies across width W of at least one support rib 102 and length L differs for at least a first support rib 102 with respect to at least a second support rib 102. FIG. 3 shows, for example, positions 4, 5, 6 along width W, with respective lengths L6, L7, L8, which vary from each other. Support rib 102C has length L9 and support rib 102D has length L10. Any of these three alternatives can be used depending on the external shape of body 110 because the support ribs 102 collectively form a discontinuous contour that matches the contour of a surface of body 110. Matching the contour of the surface of body 110 provides more points of support between support ribs 102 and body 110, to prevent or reduce deformation of body 110 caused by the weight of body 110 under gravity during heating or firing. Providing more points of support enables greater spacing distance S between adjacent support ribs 102.

Support ribs 102 can have a small thickness relative to length L and width W, and the separation of each support rib 102 by spacing distance S is adequate to allow fluid flow therebetween. Spacing distance S can vary depending on the rigidity of body 110 under heating conditions, and the desirability of moving fluid around body 110. In other words, spacing distance S can be as large as practical to facilitate fluid flow through fixture 100 and around body 110, without spacing ribs 102 too far apart to properly support body 110 such that body 110 deforms under the force of gravity and under heating conditions to a level determined by a user to be undesirable or unacceptable. A relatively small thickness T also reduces the surface area of body 110 covered by fixture 100, and reduces the overall weight and material of fixture 100. The increased exposure of surface of body 110 facilitates more even heating around body 110. Decreased mass in the oven can increase heating efficiency, lower the cost of heating, and lower the cost of heating and of fixture 100.

Figure 4:
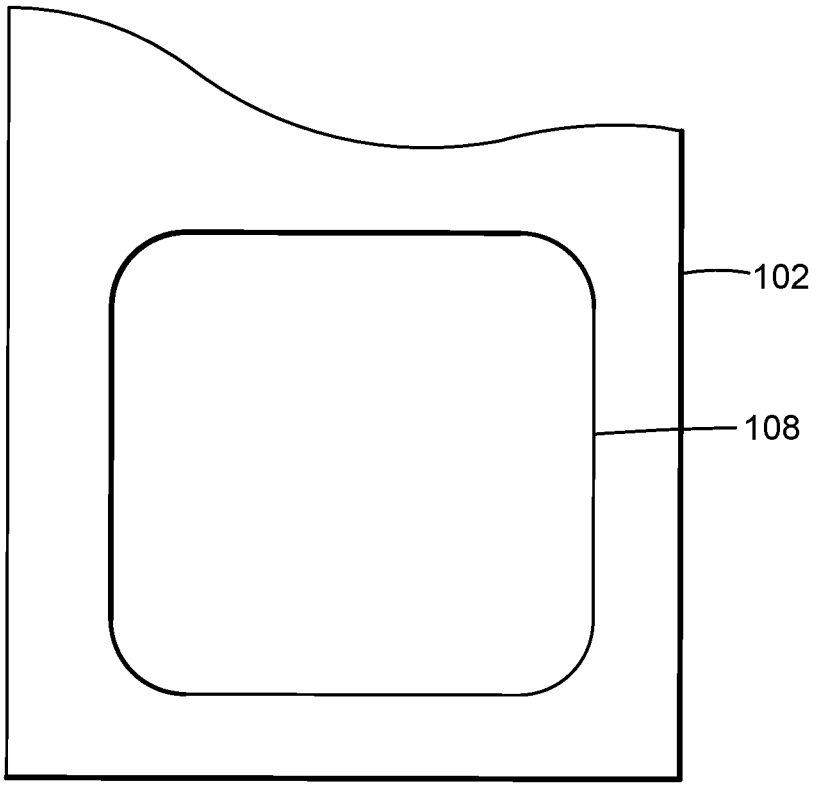
FIG. 4 is a front view of a support rib showing an alternative arrangement of one ventilation hole in the support rib, according to one embodiment.

Support ribs 102 can also facilitate fluid flow with a plurality of ventilation openings 108, each ventilation opening 108 being through thickness T of a respective support rib 102. Each support rib 102 can define one or more openings 108. FIG. 1 shows an embodiment with multiple ventilation holes 108 per support rib 102, while FIG. 4 shows an alternate embodiment with one ventilation hole 108 in a support rib 102. Many other variations are conceived. Collectively, ventilation openings 108 can be as large as practical, to facilitate fluid flow through support ribs 102 and around body 110, without sacrificing more structural integrity than necessary to properly support body 110. The acceptable maximum size of ventilation openings 108 can vary significantly depending on the size and weight of body 110, as well as the material strength, spacing distance S, dimensions, and connection region 104 of support ribs 110. In some cases, ventilation openings 108 occupy more than half of what would otherwise be the volume of support ribs 102. In some cases, ventilation openings 108 occupy up to 60%, 70%, 80%, 90%, or 95% of what would otherwise be the volume of support ribs 102.

Figure 5:
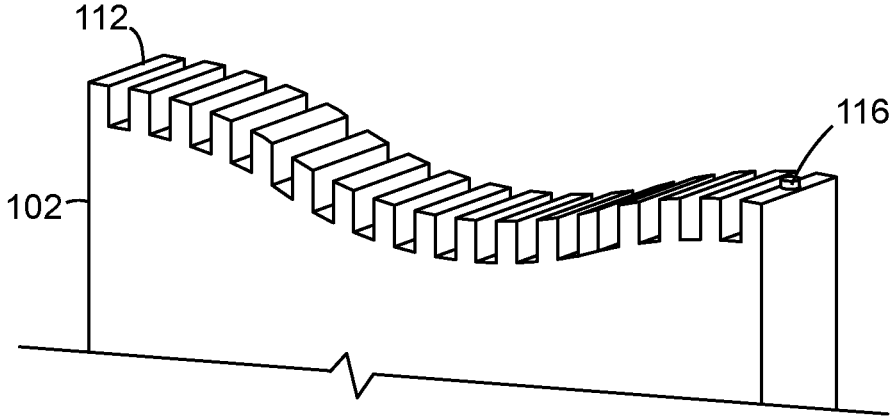
FIG. 5 is a perspective view showing a textured surface of a rib, according to an embodiment.
Figure 6:
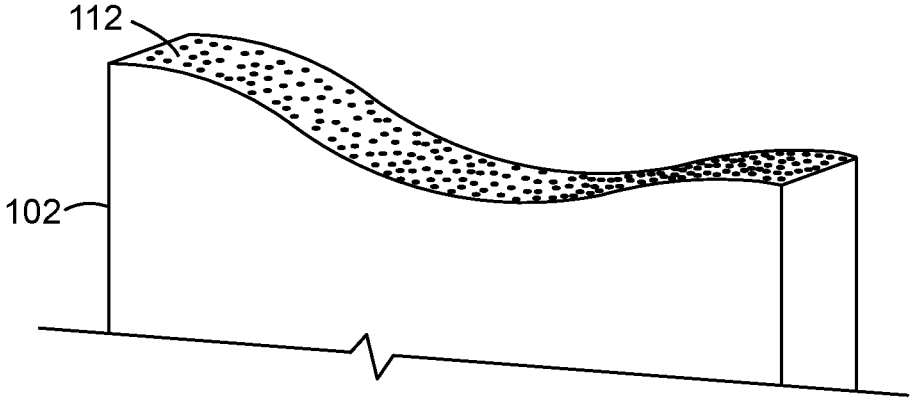
FIG. 6 is a perspective view showing a textured surface of a rib, according to an embodiment.
Figure 7:
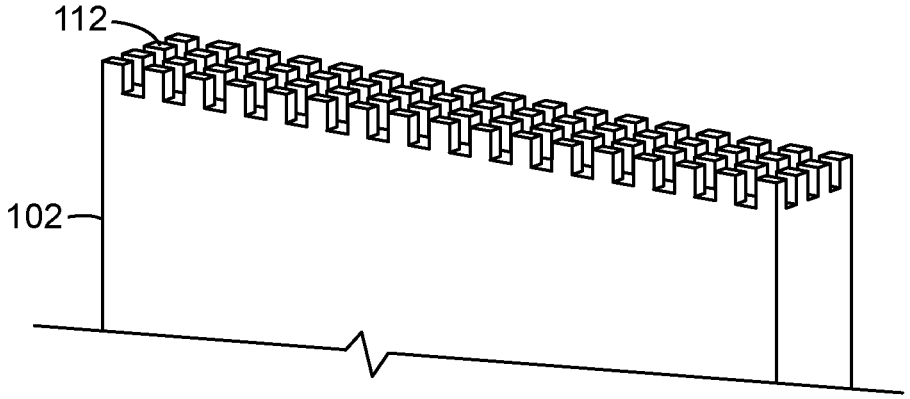
FIG. 7 is a perspective view showing a textured surface of a rib, according to an embodiment.

Each support rib 102 can further facilitate fluid flow to and around body 110 with a textured surface 112 at an end of length L thereof. Textured surface 112 can face away from connection region 104 and/or support element 106. The texture of textured surface 112 includes, but is not limited to, dimples, grooves, slots, depressions, and peaks, which are shin FIGS. 5, 6, and 7. The texturing can further reduce the amount of contact surface between support ribs 102 and body 110, which exposes more surface of body 110 to fluid. The reduced contact surface area between support ribs 102 and body 110 can also reduce friction to facilitate free movement of body 110 on fixture 100. For example, when body 110 is heated, it can dry and/or shrink, causing movement between body 110 and fixture 102. Reducing friction between body 110 and fixture 102 can facilitate this movement and avoid unnecessary stress that could cause damage to body 110.

Support ribs 102 can have a first face and a second face, with at least one of the first face and the second face of each support rib of the plurality of support ribs opposing at least one of the first face and the second face of an adjacent support rib At least one fluid guide vane 114 can also be included on at least one support rib 102 of the plurality of support ribs 102. Fluid guide vanes 114 can be on first face 103 and/or second face 105, to direct fluid flow as desired and to increase or decrease heat to a desired area of body 110.

At least one support rib 102 can have a datum 116 (seen in FIG. 2 and FIG. 5) to locate body 110 on support ribs 102 and constrain any potential shrinkage of body 110 in a controlled direction. Datum 116 can be on the surface facing away from connection region 104 and/or support element 106 (i.e. surface upon which body 110 rests). Datum 116 can be a protrusion, such as a post, pin, or bar; or datum 116 can be a recess, such as a hole or slot. Body 110 can have a corresponding feature to mate with datum 116. As discussed above, when body 110 is heated, it can dry and/or shrink, causing movement between body 110 and fixture 102. Datum 116 can be positioned on any support rib 102 to center movement of body 110 caused by shrinkage around datum 116. Datum 116 can be positioned, for example, at a far end of fixture 100 (e.g., on an end support rib 102) to engage with an end of body 110, and to allow movement of body 110 toward the end engaged with datum 116, as body 110 shrinks. Datum 116 can be positioned, for example, on a support rib 102 between the ends to engage with body 110 near the middle of body 110, to allow movement from both ends of body 110 toward the middle during shrinkage.

As shown in FIG. 1, support element 106 can be a base at the bottom of support ribs 102, such that length L of each support rib 102 extends from support element 106 to a first end 118 of each support rib 102. In the case support element 106 is a base, support element 106 has a first side 120 and a second side 122 facing away from first side 120, and support ribs 102 extend only from second side 122. The base can be the bottom-most support upon which fixture 100 can rest when supporting body 110, or support legs 126 can extend from first side 120, and provide the bottom-most support upon which fixture 100 can rest when supporting body 110.

Figure 8:
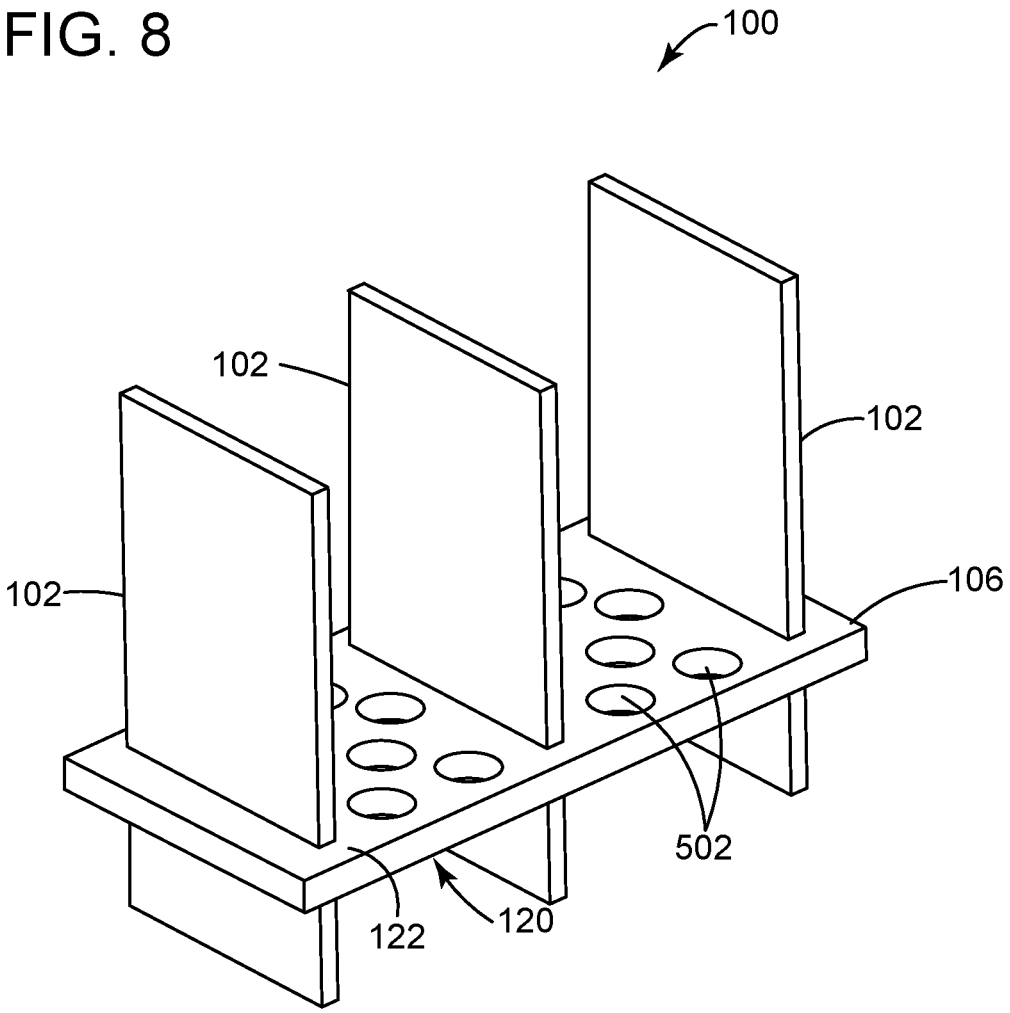
FIG. 8 is a perspective view of a portion of a turbomachine according to various embodiments.

Alternatively, as shown in FIG. 8, support element 106 can be at an intermediate position along length L of support ribs 102. Support ribs 102 can provide the bottom-most support upon which fixture 100 can rest when supporting body 110. As a base, support element 106 can leave more space between support element 106 and body 110 for fluid flow. At an intermediate position along length L of support ribs 102, support element 106 can provide more structural support to fixture 100.

Referring to FIG. 8, support element 106 can also facilitate fluid flow to and around body 110 with ventilation openings 502 therein from first side 120 to second side 122. Ventilation openings 502 can vary in size and pattern, balancing the desire for fluid flow against the desire for structural stability.

Figure 9:
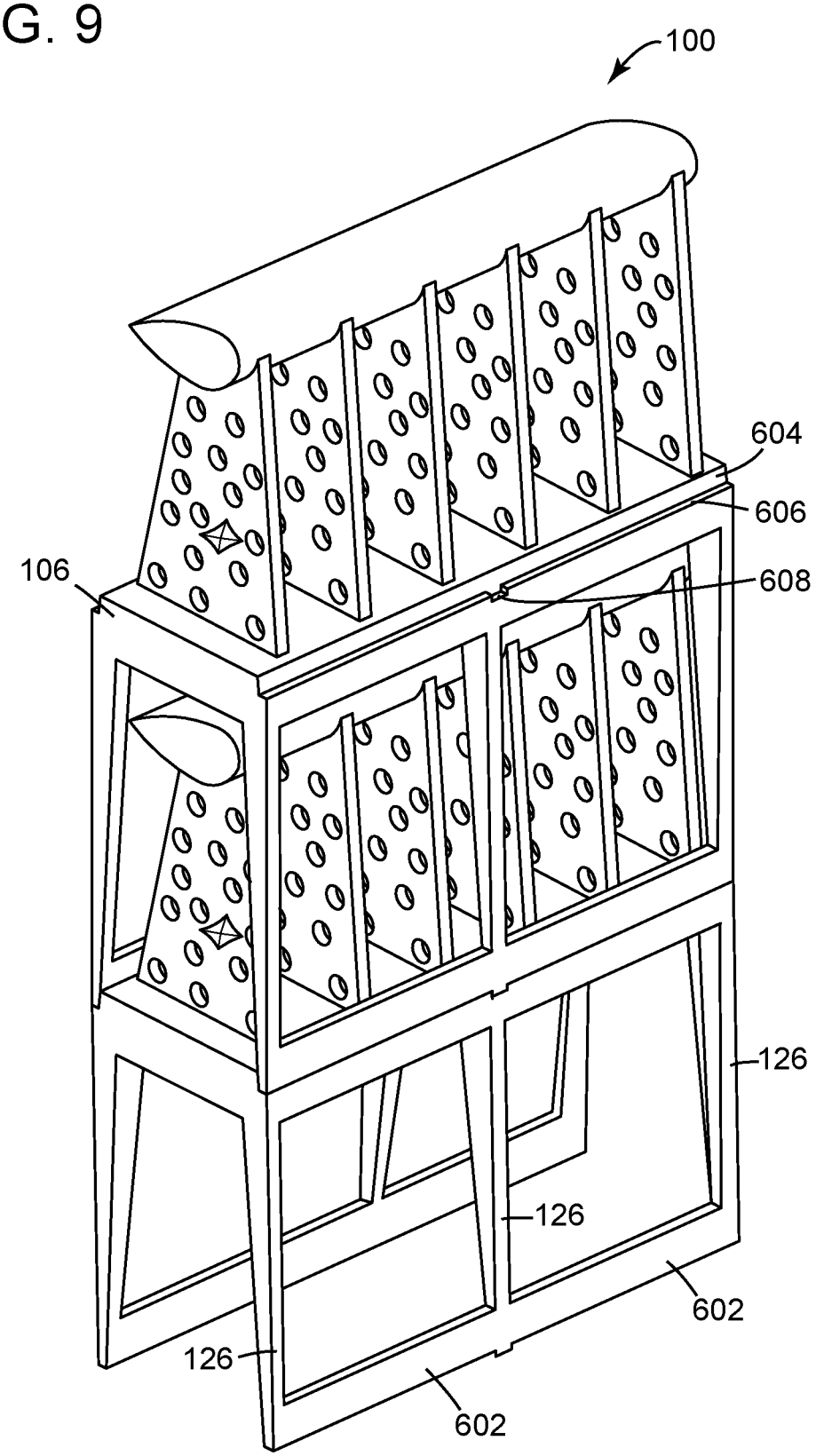
FIG. 9 shows a stack of fixtures, according to various embodiments.

As shown in FIG. 9, fixtures 100 can be configured to stack upon one another. Each stackable fixture 100 can have at least one first fixture engagement element 602 and at least one second fixture engagement element 604. First fixture engagement element 602 can include a rail extending between support legs 126. Second fixture engagement element 604 can include a ledge 606 upon which first fixture engagement element 602 (e.g., rail) and/or support legs 126 of another fixture 100 can rest. Ledge 606 can be on the support element 106. Second fixture engagement element 602 can also include a notch 608 in ledge 606 to mate with a support leg 126 and the support element has a dimension parallel to the length of the plurality of support ribs, and wherein the length of at least one support rib is greater than the dimension of the support element.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:
an article having a body;
a fixture for supporting the body, the fixture including:
a support element; and
a plurality of support ribs configured to support the body, each of the plurality of support ribs connected to and extending from the support element,
wherein each support rib of the plurality of support ribs includes:
a connection region connecting the support rib to the support element,
a textured surface positioned opposite the connection region and the support element, the textured surface shaped to directly contact and directly receive the body,
a length extending from the support element to the textured surface,
a width extending perpendicular to the length, and
a thickness extending perpendicular to the length and the width,
wherein the width is longer than the thickness, and the length varies across the width of at least one support rib of the plurality of support ribs, and
wherein the textured surface of each support rib of the plurality of support ribs define a contact surface area less than a total surface area of the textured surface, and the textured surface further includes a contact location where a portion of the body is in direct slidable contact with the texture surface such that the textured surface permits sliding movement of the body relative to the plurality of support ribs at the contact location.

2. The system of claim 1, wherein the length differs for at least a first support rib of the plurality of support ribs with respect to at least a second support rib of the plurality of support ribs.

3. The system of claim 1, wherein the plurality of support ribs collectively form a discontinuous contour that matches the contour of a surface of the body.

4. The system of claim 1, wherein the support element has a first side and a second side facing away from the first side, and wherein the support element includes ventilation openings extending through the support element from the first side to the second side.

5. The system of claim 1, wherein the support element is a base of the fixture and has a first side and an opposing second side, the plurality of support ribs extending only from the second side.

6. The system of claim 5, further comprising a first fixture engagement element and a second fixture engagement element, the first fixture engagement element and the second fixture engagement element configured to stack the fixture with another fixture by engaging the first fixture engagement element with another second fixture engagement element of the other fixture.

7. The system of claim 5, further comprising support legs extending from the opposing second side.

8. The system of claim 1, wherein each of the plurality of textured surfaces includes at least one of dimples, grooves, slots, depressions, or peaks configured to define the contact surface area.

9. The system of claim 1, wherein the plurality of support ribs includes a plurality of ventilation openings, each ventilation opening extending through the thickness of a respective support rib of the plurality of support ribs.

10. The system of claim 1, wherein the support element includes at least one ventilation opening extending therethrough.

11. The system of claim 1, wherein the fixture comprises a metal or a ceramic refractory material.

12. The system of claim 11, wherein the ceramic refractory material includes at least one of a ferrous material, a non-ferrous material, or a composite material.

13. The system of claim 11, wherein the metal or ceramic refractory material has a melting point above 500 degrees Fahrenheit.

14. The system of claim 1, further comprising at least one fluid guide vane on at least one support rib of the plurality of support ribs.

15. The system of claim 1, further comprising a datum positioned on one of the plurality of support ribs, the datum being configured to locate the body and partially constrain the sliding movement of the body relative to the plurality of support ribs during body shrinkage, the datum being on one of the plurality of textured surfaces.

16. The system of claim 1, wherein the support element has a dimension parallel to the length of the plurality of support ribs, and wherein the length of at least one support rib is greater than the dimension of the support element.

17. A system comprising:

an article having a body;

a plurality of support ribs to support the body, wherein the body is slidably mounted on a first end of each of the plurality of support ribs, wherein:

the first end of each support rib includes a textured surface directly contacting and directly receiving the body, the textured surface projecting outwardly from the first end to define a reduced contact surface area relative to a total surface area of the first end, and the textured surface further includes a contact location where a portion of the body is in direct slidable contact with the texture surface so as to permits sliding movement of the body relative to the plurality of support ribs at the contact location, each support rib on the plurality of connected support ribs spaced from at least one other support rib of the plurality of connected support ribs, each support rib of the plurality of connected support ribs having a first face and a second face, at least one of the first face and the second face of each support rib of the plurality of connected support ribs opposing at least one of the first face and the second face of an adjacent support rib, each support rib further having a length, a width, a thickness, and a second end opposing the first end, the length extending from the body to the second end, the width extending perpendicular to the length, the thickness extending perpendicular to the length and the width, the width longer than the thickness, and the length varies across the width of at least one support rib of the plurality of connected support ribs.

18. The system of claim 17, further comprising a datum positioned on one of the plurality of connected support ribs, the datum being configured to locate the body and partially constrain the sliding movement of the body relative to the plurality of support ribs during body shrinkage, the datum being on the textured surface of the first end of one of the plurality of connected support ribs.

* * * * *